114-242
1/18/77 OR SR 4,003,329

United States Patent [19]
Robinson

[11] 4,003,329
[45] Jan. 18, 1977

[54] COMBINATION POSITIONING AND PROPELLING APPARATUS FOR BARGES

[75] Inventor: Horace John Robinson, Dublin, Pa.
[73] Assignee: FMC Corporation, San Jose, Calif.

[22] Filed: July 26, 1973
[21] Appl. No.: 382,784
[52] U.S. Cl. ..... 114/242; 104/163; 104/168; 115/6; 214/14
[51] Int. Cl.² ..... B63B 21/56
[58] Field of Search ..... 114/235 R, 44, .5 BD, 114/43.5; 115/6, 8; 198/167, 127; 104/162, 163, 168; 214/14; 61/57, 48

[56] References Cited

UNITED STATES PATENTS

| | | | |
|---|---|---|---|
| 1,058,306 | 4/1913 | Kindl | 214/14 |
| 3,104,766 | 9/1963 | Sasadi | 214/14 |
| 3,362,546 | 1/1968 | Sale | 214/14 |
| 3,770,145 | 11/1973 | Uhrich | 214/14 |

FOREIGN PATENTS OR APPLICATIONS

| | | | |
|---|---|---|---|
| 1,455,008 | 10/1969 | Germany | 104/168 |
| 1,167,872 | 4/1964 | Germany | 104/168 |
| 50,021 | 9/1965 | Poland | 104/168 |

*Primary Examiner*—Trygve M. Blix
*Assistant Examiner*—Stuart M. Goldstein
*Attorney, Agent, or Firm*—C. E. Tripp; J. F. Verhoeven

[57] ABSTRACT

Combination barge positioning and propelling apparatus utilizing a plurality of powered, reversible traction devices in frictional contact with the vertical sides of the barge is disclosed. Several embodiments of the apparatus are shown to accommodate various widths of barges and variations in the water level and/or draft of the barges.

3 Claims, 20 Drawing Figures 16
16
15
15
30
34
34
36
32a
180
191
208
218
214
220
190
217
209
222
224
216
212
210
213
194
195
196
186
189

COMBINATION POSITIONING AND PROPELLING APPARATUS FOR BARGES

BACKGROUND OF THE INVENTION

1. Field of the Invention

This invention relates to barge haulage systems and to the art of moving non-self-propelled barges in a channel or alongside of a pier, particularly when unloading of a bulk material carried within the barge is to be accomplished and both forward and backward motion of the barge is required during several passes of the barge by the unloading device.

2. Description of the Prior Art

Barge haul systems using one or more powered winches and wire ropes reeved from the drums of the winches around suitably located sheaves to each end of the barge so that reversible movement of the barge may be obtained are old in the art. Such rope operated barge haul systems are disclosed in U.S. Pat. Nos. 2,773,608 to R. E. HUNT et al; 3,104,766 to J. SASADI; 3,307,717 to C. LUDWIG and 3,497,054 to J. P. VAN KLEUNEN.

The use of tugs for moving barges within the unloading area is also old, but it is generally preferred to maintain control of the barges from within the operator's control station of the unloading device.

In U.S. Pat. No. 3,362,546 to D. B. SALE a barge unloading device is disclosed wherein angularly positioned rubber tired wheels attached to the movable unloader carriage make contact with a rail on each longitudinal side of the top of the barge to guide the barge as it is moved through the area of the unloader and to index the unloader with respect to the bottom of the barge. This patent further discloses that the indexing wheels may be power driven to urge the barge longitudinally through the truss of the unloading device.

SUMMARY OF THE INVENTION

The apparatus of the invention provides a combination positioning and propelling mechanism assembly for moving barges in their longitudinal direction either forward or backward by obtaining traction through the use of frictional contact of a plurality of power driven devices applied to the vertical longitudinal sides of the barge. The system is generally applicable when moving bulk material handling barges through stationary loading and unloading facilities.

In the preferred form of the apparatus a plurality of combination positioning and propelling mechanism assemblies supporting power driven pneumatic tired wheels are located at spaced intervals longitudinally on both sides of the barge to position and to maintain control of the barge as well as to provide traction for moving the barge. Since the barges to be handled are usually of varying widths, the propelling mechanisms on one side are generally fixed transversely while the propelling mechanisms on the opposite side of the barge are adjustable transversely of the barge. Each propelling mechanism has a power driven reversible wheel supported from a structure over the top of the barge. The assembly is provided with means to apply lateral pressure of the wheel against the vertical side of the barge on at least one side. The wheel has a low pressure relatively large size rubber tire having a rough surface tread so as to make good frictional contact tangentially with the side of the barge and provide adequate traction. The plurality of wheels are driven in unison in the proper direction to obtain the desired direction of movement of the barge and their speed may be varied so as to obtain a slow speed while passing through the unloading device in the digging mode and a higher speed for returning the barge to its original starting position in preparation for a second digging pass.

Embodiments of the apparatus are disclosed where several propelling mechanisms may be mounted on a vertically liftable bridge to provide for wide variations in water level and/or draft of the barges. The propelling mechanisms may also be pivoted vertically about a horizontal axis to provide for varying width barges.

In the loading and unloading of bulk material handling barges it has been conventional practice to use a wire rope and winch barge haul system to move the barges through a loading and/or unloading facility. Conventional wire rope haulage systems require operational delays for attaching and removing of the haulage ropes. Delays are also experienced when positioning the ropes for attachment to different barges. Manual handling of the long ropes and the moving ropes themselves along the entire dock face represent undesirable safety hazards. It is also frequently necessary with conventional rope haulage systems to employ secondary equipment, commonly known as breasting devices, to maintain contact of the barge with the dock face during substantial offshore winds and currents.

It is therefore an object of the invention to provide apparatus for moving barges not requiring the use of rope haulage systems with their possible delays and safety hazards.

It is a further object to provide a barge moving system where the tug can deliver a barge into one end of the facility and not be required until the barge is to be moved away from the facility at the completion of the loading or unloading operation.

It is another object to provide a barge moving system utilizing the tractive effort of a moving device in frictional contact only with vertical sides of the barge.

It is yet another object to utilize rotating wheels with low pressure pneumatic rubber tires for the frictional contact with the vertical sides of the barge to obtain traction for moving the barge.

The nature of the invention will become more apparent upon consideration of the figures of the accompanying drawings and the associated description.

BRIEF DESCRIPTION OF THE DRAWINGS

FIG. 6 is a sectional view taken along line 6—6 of FIG. 5.

DESCRIPTION OF THE PREFERRED EMBODIMENTS

In the loading and unloading of bulk material handling barges in high volume operations it is usually necessary to move the barges through the loading or unloading apparatus in several passes to maintain stability of the barge. It is further necessary for the barge to be closely controlled in its movement parallel to the dock face, particularly when an unloading device is digging and removing material from within the barge. Means to closely control the barge and to move the barge longitudinally through the loading or unloading apparatus while under the control of the operator of the loading or unloading apparatus is thus highly desirable for fast, economical and safe operation.

Figure 1:
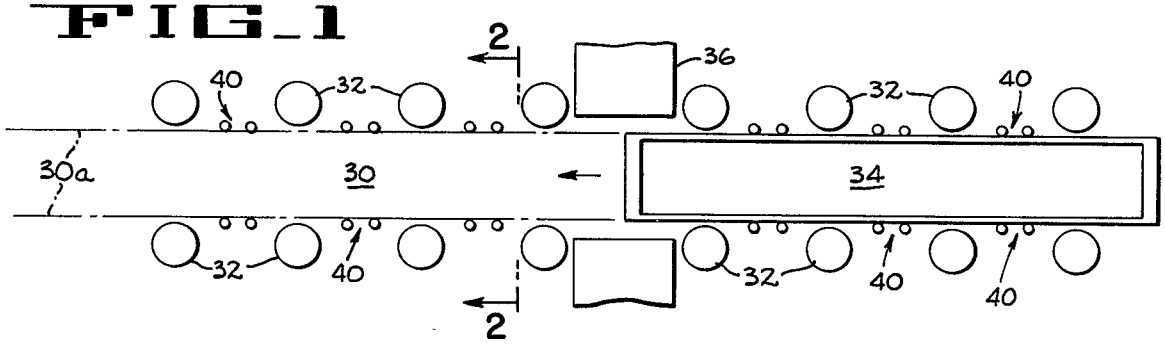
FIG. 1 is a schematic plan view of a barge handling system using the method and apparatus of the invention.

The system of the present invention for moving barges longitudinally is schematically shown in FIG. 1. A confined channel 30, defined by piers or floating cells 32, is indicated by dotted lines 30a between which a barge 34 is moved past an unloader station 36. A plurality of combination barge positioning and propelling mechanism assemblies 40 spanning the channel 30 are longitudinally spaced along channel 30 so as to receive a barge. A tug moves the barge into one end of channel 30 and within the area of several of the combination positioning and propelling mechanism assemblies 40, which will be described in detail hereinafter. Tractional devices on the propelling mechanisms are then brought into contact with the vertical sides of the barge and driven in unison to advance the barge through the unloading staion 36. The tractional devices make frictional contact with the vertical sides of the barge and thus provide the tractional force to move the barges. As the barge moves forward successive tractional devices come into contact with the sides of the barges. After completing one digging pass of the unloader the tractional devices are reversed to return the barge to its initial position so that a second and/or third pass may be made. At the conclusion of unloading, the barge is advanced to a forward position where the tug can again make contact and so remove the unloaded barge from the area and then bring in another loaded barge at the opposite end.

In the preferred embodiment of the apparatus for the present invention, as shown in FIGS. 1–4, the combination positioning and propelling mechanism assembly 40 is indicated as having two propelling mechanism units on each side of the channel 30 although any number of propelling mechanism units may be provided. A plurality of these combination positioning and propelling assemblies is provided along the channel 30 on each side of the loading or unloading station 36 as may be required by the size of the barges to be handled.

Figure 3:
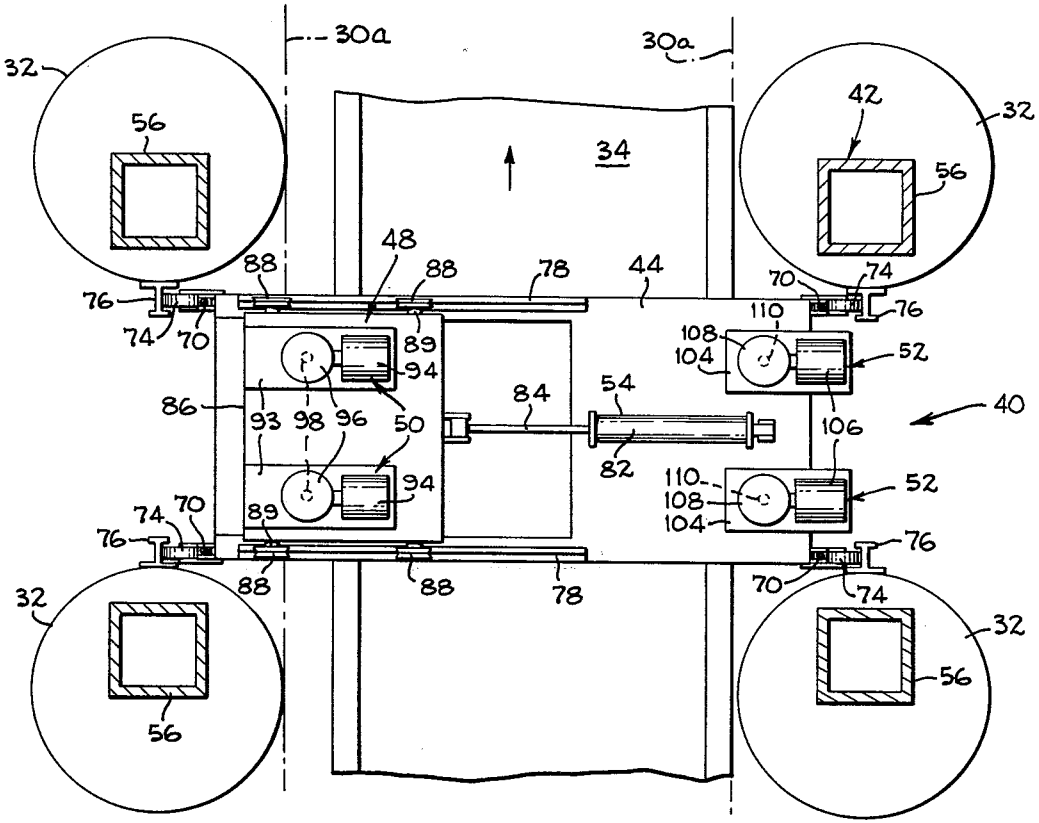
FIG. 3 is a plan view taken along line 3—3 of FIG. 2.
Figure 4:
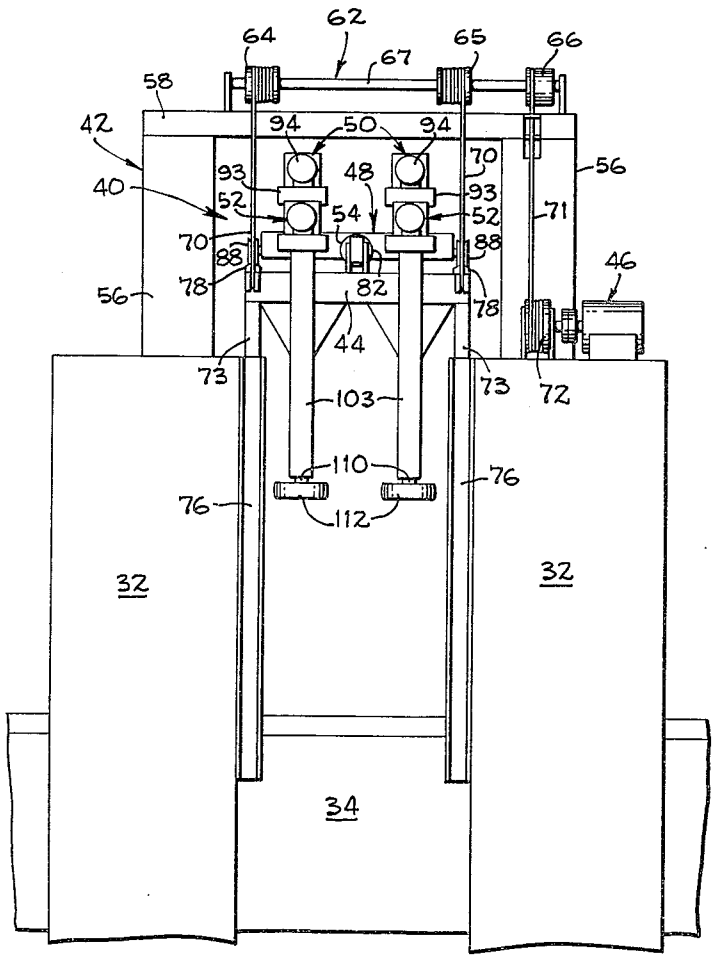
FIG. 4 is a longitudinal elevation taken along line 4—4 of FIG. 2 showing the propelling mechanisms in their raised non-operating position.
Figure 2:
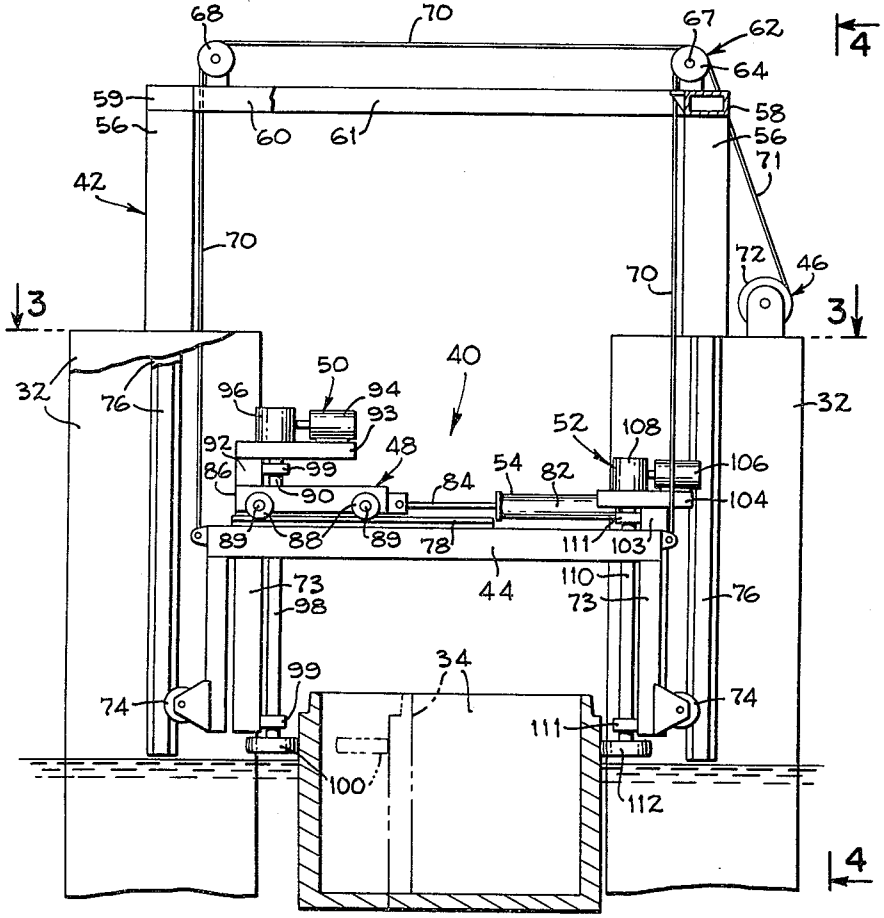
FIG. 2 is a transverse section of the apparatus of the preferred embodiment taken along lines 2—2 of FIG. 1.

The combination positioning and propelling mechanism assembly as shown in FIGS. 2–4 comprises a fixed supporting structure 42, a liftable bridge 44, a hoist unit 46, a movable carriage 48, two laterally adjustable propelling mechanism units 50, two laterally fixed propelling mechanism units 52, and power means 54 to move carriage 48 laterally.

The supporting structure 42 is a structural frame having four vertical towers 56, two horizontal longitudinal beams or trusses 58 and 59, and two horizontal transverse beams or trusses 60 and 61 secured to the top of the towers 56 forming a rectangular structure transversely spanning the channel and longitudinally connecting two sets of piers or cells. Each tower 56 is secured at its base to a pier or cell and extends vertically so that transverse beams 60 and 61 clear the propelling mechanism units 50 and 52 when the bridge 44 is in its raised position with the propelling mechanism units disengaged from and above the top of the barge under high water conditions. One longitudinal beam 58 supports a drum shaft assembly 62 having at least three laterally spaced wire rope drums 64, 65, 66 mounted on a common shaft 67. The other longitudinal beam 59 supports two wire rope sheaves 68. Wire rope cables 70 are secured at one end to each corner of bridge 44. Two of the cables 70 are reeved over sheaves 68 to drums 64 and 65 while the other two cables 70 are reeved directly to drums 64 and 65 also of drum shaft assembly 62. Another wire rope cable 71 is attached to outboard drum 66 and is led directly to drum 72 of hoist unit 46 which is a conventional drum type winch unit driven through gearing and an electric motor. Operation of the above wire rope hoisting system by driving hoist unit 46 moves cables 70 and 71 and thus lifts or lowers bridge 44 with its propelling mechanisms 50 and 52 supported thereon.

Bridge 44 is a rectangular structural frame having depending leg beams 73 at each corner. Each leg beam 73 supports a guide roller 74 at its lower end. The guide rollers 74 operate in mating vertical guide rails 76 secured to the sides of piers 32 to guide bridge 44 during its vertical travel. On the top surface of bridge 44 a pair of longitudinally spaced rails 78 running transversely of channel 30 are provided. The wheeled carriage 48 operates on rails 78 and the carriage is moved transversely of channel 30 by power means 54. Power means 54 comprises a hydraulic power cylinder 82 centrally pivoted to bridge 44 and having a conventional hydraulic power unit (not shown) supplying fluid under pressure to power cylinder 82. Piston rod 84 of cylinder 82 is connected to carriage 48 to move the carriage.

Carriage 48 comprises a body frame 86, four wheels 88 mounted on axles 89 supported from the body frame 86, and a supporting structure 90 for propelling mechanisms 50. Supporting structure 90 has a pair of vertical legs 92 depending from the outboard end of frame 86 and a drive support platform 93.

A pair of laterally adjustable longitudinally spaced propelling mechanism units 50 is supported on frame 86 so that by movement of carriage 48, the propelling mechanism units may be positioned against the vertical side of varying width barges 34. Each propelling mechanism unit 50 comprises a variable speed electric motor 94, a reversible gear reducer 96, a vertical shaft 98, a pair of bearings 99 and a tractional device 100. The motor 94 is coupled to reducer 96 and is mounted on drive support platform 93. A low speed output shaft of reducer 96 extending below the platform is coupled to vertical shaft 98 which is rotatably supported in the pair of vertically spaced bearings 99. The pair of bearings 99 is attached to one vertical leg 92 of supporting structure 90. The tractional device or traction wheel 100 in the preferred embodiment is a wheel equipped with a relatively low pressure pneumatic tire having a high friction tread, such as commonly used on earth moving machines or all-terrain vehicles. The traction wheel 100 is rotatably driven by motor 94 and gear reducer 96 in either direction of rotation as desired and its speed may be varied to obtain the desired speed of travel of the barge. Other forms of the tractional device 100 may include a rotatable drum, such as a conveyor pulley, with a thick resilient covering, or lagging, having herringbone type grooving in its outer surface for additional friction, or a short center caterpillar type belt conveyor having an endless conveyor belt with a high friction outer surface, or cleated surface, operating vertically between two pulleys, one power driven and one adjustable for belt takeup purposes so the vertical outer surface of the conveyor belt contacts the side of the barge.

A pair of laterally fixed longitudinally spaced propelling mechanism units 52 is also provided on bridge 44. At the end of the bridge laterally opposite from the carriage 48, a pair of supporting structures, each having a vertical leg 103 depending vertically from the bridge 44 and an upper drive support platform 104, is securely attached to the bridge adjacent its lateral end. Each propelling mechanism unit 52 comprises a variable speed electric motor 106, a reversible gear reducer 108, a vertical shaft 110, a pair of bearings 111 and a tractional device or traction wheel 112. The motor 106 is coupled to reducer 108 and is mounted on drive support platform 104. A low speed output shaft of reducer 108, extending below the drive support platform, is coupled to vertical shaft 110 which is rotatably supported in the pair of vertically spaced bearings 111. The pair of bearings 111 is attached to the vertical leg 103 depending from bridge 44. The traction wheel 112 having a relatively large low pressure pneumatic rubber tire, such as commonly used on earth moving machines or all-terrain vehicles, is mounted on the lower end of vertical shaft 110. Traction wheel 112 is rotatably driven by motor 106 and reducer 108 in either direction as desired. Propelling mechanism units 52 are thus similar to propelling mechanism units 50 except that they are laterally fixed whereas propelling mechanism units 50 are laterally adjustable by means of movable carriage 48 on which they are supported.

In operation, the bridge 44 is raised and the barge to be handled is delivered by a tug to one end of the several combination positioning and propelling mechanism assemblies 40. Each bridge is then lowered so that the rubber tired wheels 100 of the propelling mechanism units are adjacent the upper vertical sides of the barge. The carriage 48 is then moved laterally bringing the traction wheels 100 into contact with the sides of the barge. Continued hydraulic pressure applied to power cylinder 82 of the several positioning and propelling mechanism assemblies 40 in engagement with the barge will push the barge laterally sufficiently to bring the barge in firm contact with the laterally fixed wheels 112 on the opposite side of the barge. Then with both sets of traction wheels 100 and 112 in frictional contact with the barge, motors 94 and 106 can be energized to run in opposite directions of rotation so that the rotation of each set of wheels will be in the proper direction for the direction of intended travel of the barge and traction to move the barge will then be provided by this frictional contact and proper rotation of traction wheels 100 and 112.

A second embodiment of the combination barge positioning and propelling mechanism assembly of the invention is shown on FIGS. 5-10 inclusive. This embodiment provides for pivoting the propelling mechanism unit vertically about a horizontal axis so that the propelling mechanism unit is thereby adjustable to accommodate varying widths of barges and to permit the barge to remain centrally located in the channel 30.

As shown in FIGS. 5–8 the combination barge positioning and propelling mechanism assembly 115 comprises a pair of fixed supporting structures 116, a liftable bridge 118, a pair of hoist units 120, four pivoted propelling mechanism units 122 and four power means 124 for pivoting the propelling mechanism units 122.

The fixed supporting structures 116 each comprise a structural frame 126 having two vertical towers 127 and a horizontal truss or beam 128 connecting each tower 127 longitudinally to form a single rigid frame. Each tower 127 is anchored to the piers 32 and extends vertically so that the liftable bridge 118 may be raised with the propelling mechanism units 122 disengaged from and above the top of the barge under high water conditions. Each horizontal beam 128 supports a pair of wire rope sheaves 130. Wire rope cables 132 are secured at one end to each corner of bridge 118, are reeved over sheaves 130 and are led directly to the hoist units 120. Each hoist unit 120 is a conventional double drum winch unit driven through gearing and an electric motor. Simultaneous operation of hoist units 120 through cables 132 lifts or lowers bridge 118 with the propelling mechanism units 122 supported thereon.

Bridge 118 is a rectangular structural frame having depending leg beams 134 at each corner. Each leg beam 134 supports a guide roller 136 at its lower end. The guide rollers 136 operate in mating vertical guide rails 138 attached to the sides of piers 32 to guide bridge 118 in its vertical travel. Bridge 118 is further equipped with a pair of power driven holding bumpers 140 located at each end of the transverse centerline of the bridge frame. Each holding bumper comprises a hydraulic cylinder 142 having a piston rod 143 and a bumper head unit 144 attached to the end of piston rod 143. The bumper head unit 144 is advanced into contact with the vertical side walls of a well section of the pier by hydraulic pressure supplied by a conventional hydraulic power system (not shown). The bumpers hold the bridge from moving laterally or longitudinally within the well sections of the piers by their frictional contact when the propelling mechanism units 122 are in position to engage a barge. Bridge 118 also has a pair of pivot support pedestals 146 for each propelling mechanism unit 122 anchored to the bridge frame.

Figure 10:
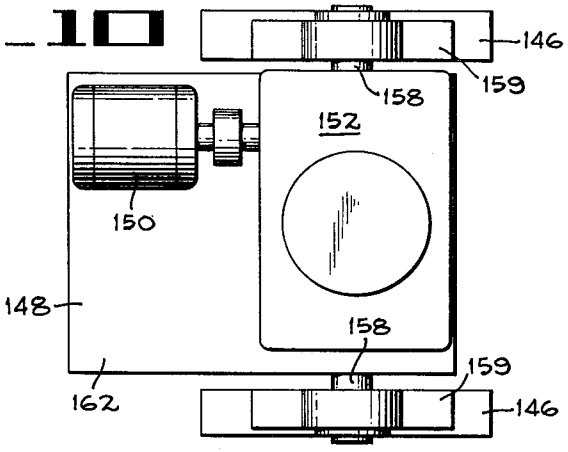
FIG. 10 is a plan view taken along line 10—10 of FIG. 9.
Figure 9:
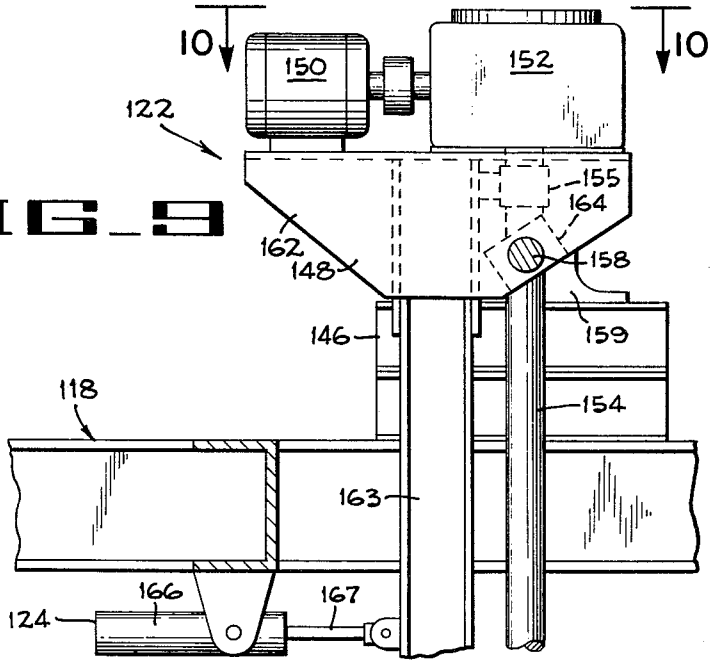
FIG. 9 is a sectional view taken along line 9—9 of FIG. 8.
Figure 8:
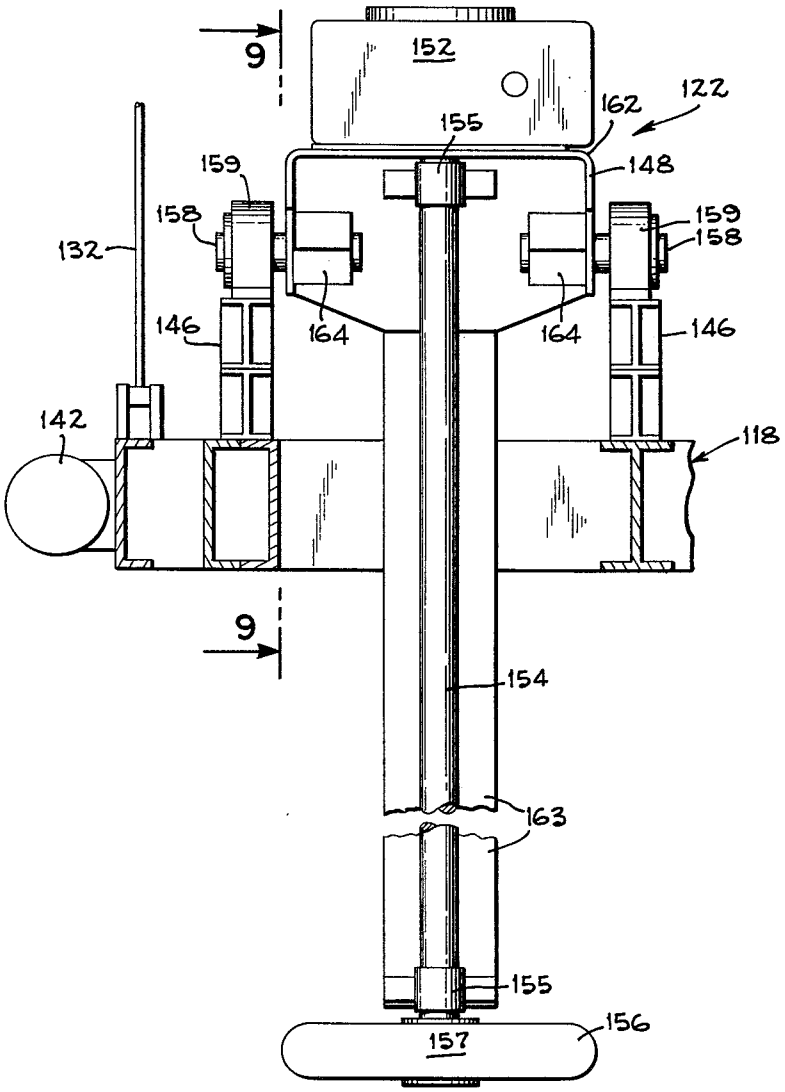
FIG. 8 is an enlarged view of the propelling mechanism of the second embodiment taken along line 8—8 of FIG. 5.

As shown more clearly in FIGS. 8–10, each propelling mechanism unit 122 comprises a drive support platform 148, a variable speed electric motor 150, a reversible gear reducer 152, a vertical shaft 154, a pair of vertical shaft bearings 155, a power driven tractional device or traction wheel 156, a pair of horizontal pivot shafts 158, and a pair of pivot shaft bearings 159. The drive support platform 148 includes a U-shaped bent plate member 162, a vertical leg beam 163 and a pair of hubs 164. The leg beam 163 is rigidly attached and braced to the bent plate member 162 to form a single T-shaped structure. The horizontal pivot shafts 158 are supported in hubs 164 and extend outwardly on either side of the bent plate member 162. The pivot shafts 158 are pivotally supported in bearings 159 which are attached to pivot support pedestals 146 on the bridge 118. Motor 150 is coupled to gear reducer 152 and mounted on top of the bent plate member 162. The low speed output shaft of the gear reducer 152, extending below the drive platform, is coupled to vertical shaft 154 which is rotatably supported in the vertically spaced pair of bearings 155. The bearings 155 are secured to vertical leg beam 163 of the drive platform 148. Traction wheel 156, having a relatively low pressure pneumatic rubber tire 157, such as commonly used in earth moving machines or all-terrain vehicles, is mounted on the lower end of vertical shaft 154. Traction wheel 156 is rotatably driven by motor and reducer 152 in either direction as desired. Power means 124 comprises a hydraulic power cylinder 166 pivotally attached to bridge 118 and having a conventional hydraulic power unit (not shown) supplying fluid under pressure to power cylinder 166. Piston rod 167 of power cylinder 166 is pivotally connected to vertical leg beam 163 to tilt the drive platform 148 vertically about a horizontal axis.

In operation, the bridge 118 is raised and the barge to be handled is delivered by a tug to one end of the several combination positioning and propelling mechanism assemblies 115. Each bridge 118 is then lowered so that the traction wheels 156 of the propelling mechanism units are adjacent the upper vertical sides of the barge. Power cylinder 166 is then operated to tilt or swing the drive platform 148 so that wheel 156 comes into contact with the sides of the barge. When the propelling mechanism units on the opposite side of the barge are similarly swung into engagement with the barge, the barge is then held laterally under control of the combination positioning and propelling mechanism assemblies. Then with the traction wheels 156 in frictional contact with both sides of the barge, motors 150 may be energized in their proper direction, depending upon their location on the sides of the barge, and traction to move the barge in the intended direction of travel will be provided by this frictional contact and the proper rotation of traction wheels 156.

Figure 11:
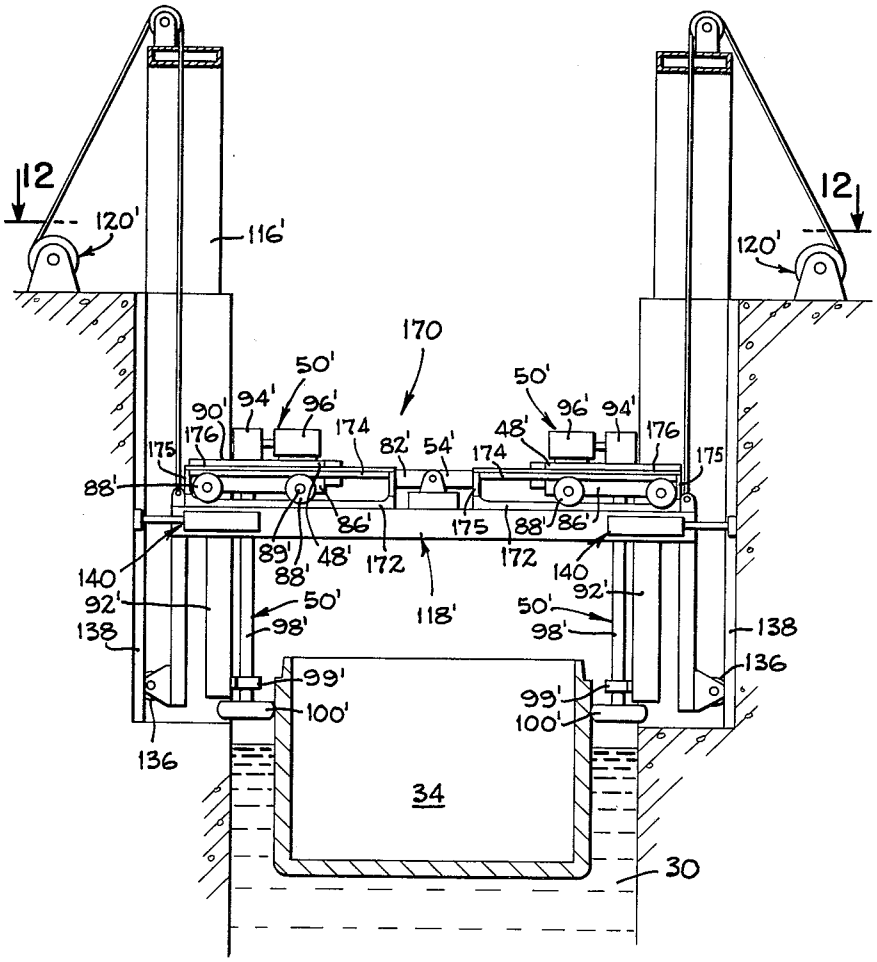
FIG. 11 is a half sectional view similar to FIG. 2, showing a third embodiment of a combined positioning and propelling mechanism assembly.
Figure 5:
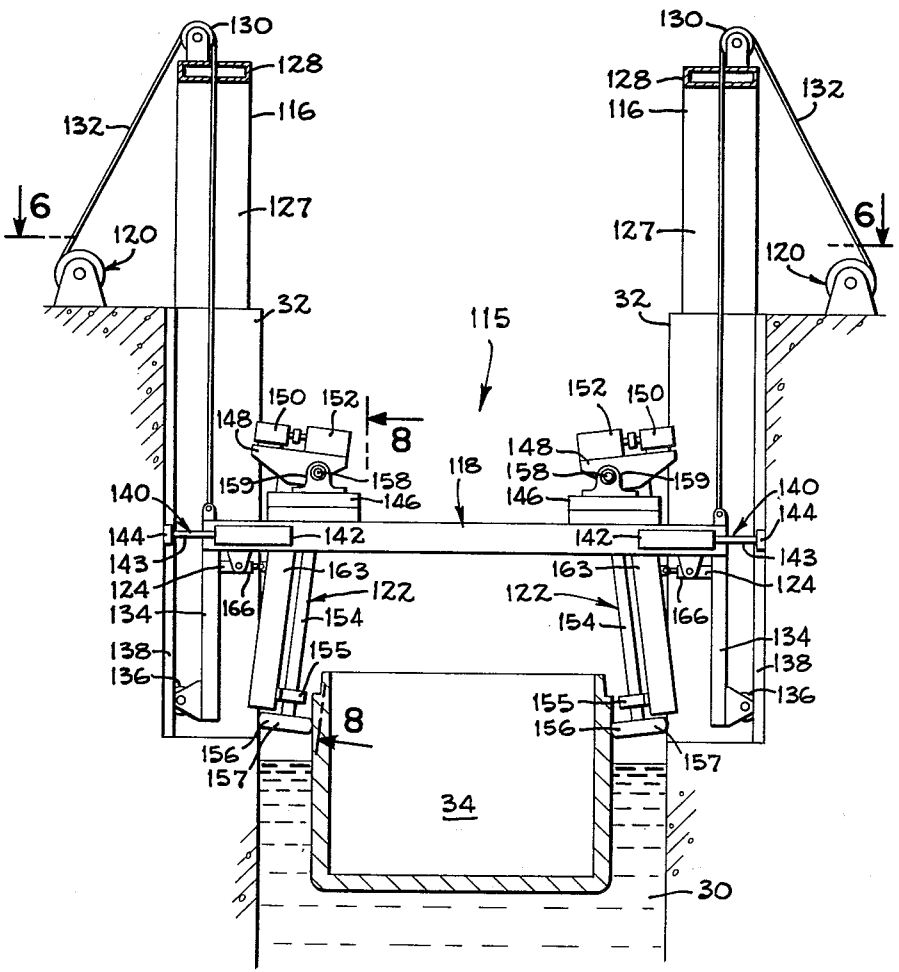
FIG. 5 is a half sectional view, similar to FIG. 2, showing a second embodiment of a combined positioning and propelling mechanism assembly.
Figure 7:
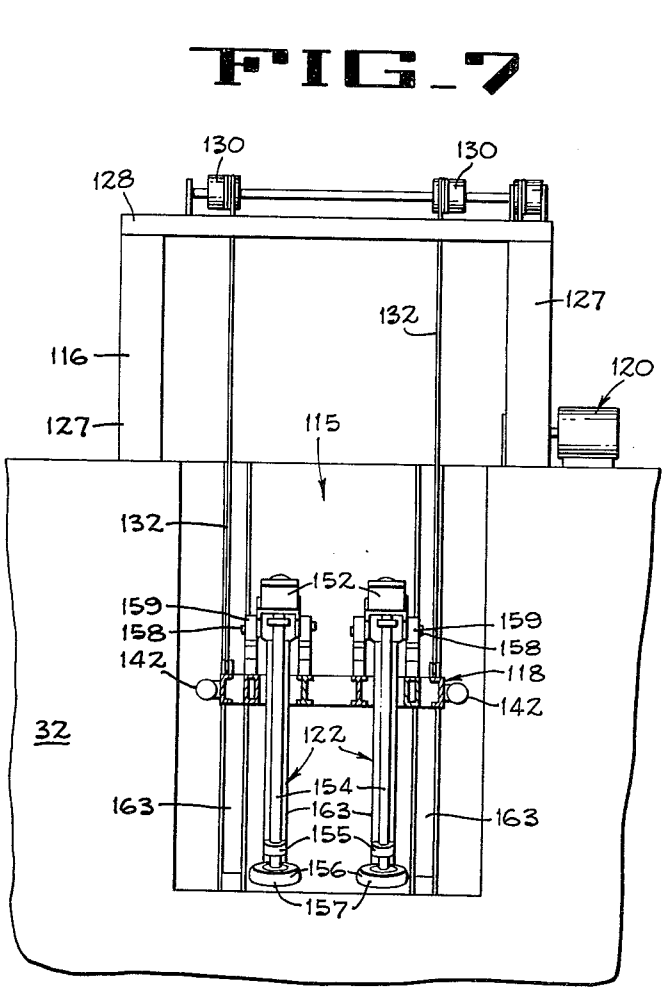
FIG. 7 is a sectional view taken along line 7—7 of FIG. 6.
Figure 5:
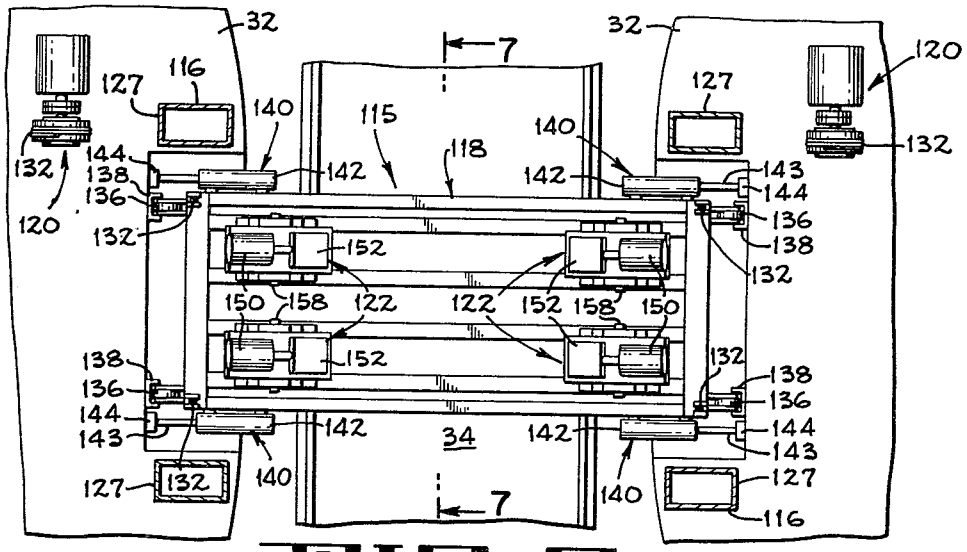
Figure 12:
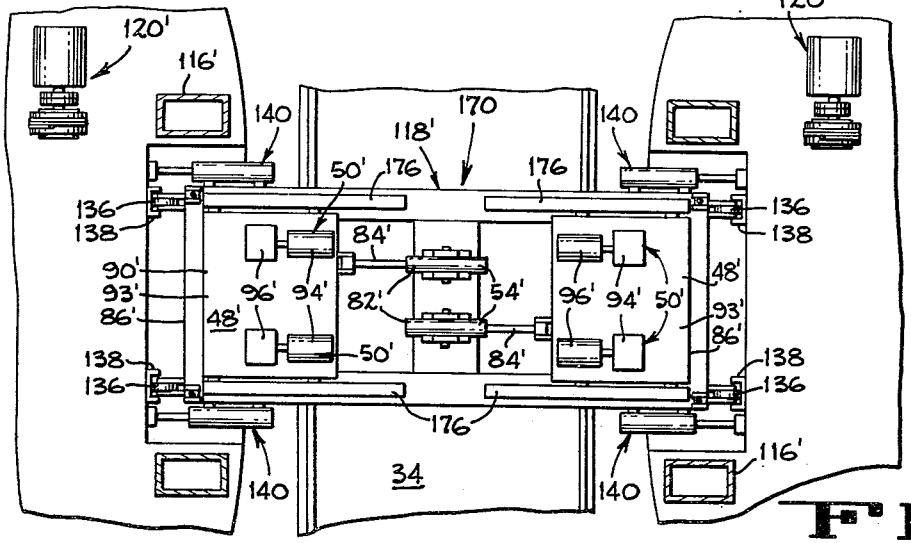
FIG. 12 is a sectional view taken along line 12—12 of FIG. 11.

A third embodiment of the combination positioning and propelling mechanism assembly 170 of the invention is shown on FIGS. 11–12. This embodiment is similar to the first embodiment, FIGS. 2–4, except that both propelling mechanism units are laterally adjustable so that varying width barges may be accommodated while still keeping the barge centrally located in the channel. The liftable bridge and supporting structure are, however, similar to that shown and described in the second embodiment, FIGS. 5–10. To avoid repetition, like parts of other embodiments will be shown by the same number but with a prime mark added.

As indicated on FIG. 12, the combination positioning and propelling mechanism assembly 170 comprises a pair of fixed supporting structures 116′, a liftable bridge 118′, a pair of hoist units 120′, a pair of movable carriages 48′, four laterally adjustable propelling mechanism units 50′ and a pair of power means 54′ to move carriages 48′ laterally. The fixed supporting structures 116′ and the hoist unit 120′ are the same as structures 116 and hoist units 120 previously described in the second embodiment. The liftable bridge 118′ is similar to bridge 118 of the second embodiment including guide rollers 136, guide rails 138 and power driven holding bumpers 140, however, pivot support pedestals 146 and the power means 160 to pivot the propelling mechanism units are not required. Bridge 118′ has two pairs of carriage support rails 172 and a pair of carriage hold-down frames 174.

Each of the two carriages 48′ is similar so only one will be described. The two carriages 48′ are located symmetrically about the centerline of bridge 118′ transversely of channel 30 and each carriage comprises a body frame 86′, four wheels 88′ mounted on axles 89′ supported from the body frame 86′, and a supporting structure 90′ for the propelling mechanism units 50′. A pair of longitudinally spaced rails 172 is mounted on the top portion of bridge 118′ and run transversely of channel 30. The carriage hold-down frames 174 which are secured to bridge 118′ in line with rails 172, include a pair of vertical legs 175, a horizontal beam 176 connecting the vertical legs 175, and a hold-down rail 177 supported from the horizontal beam 176 and vertically positioned above rail 172 on top of the wheels 88′ of carriage 48′ so that the carriage wheels are free to roll on lower rail 172, but are prevented from lifting upwardly by hold down rail 177.

Two longitudinally spaced propelling mechanism units 50′ are shown in FIG. 12 on each carriage 48′ but more may be used. Each propelling mechanism unit 50′ comprises a variable speed electric motor 94′, a reversible gear reducer 96′, a vertical shaft 98′, a pair of bearings 99′ and a traction wheel 100′. The motor 94′ is connected to the gear reducer 96′ which has a low speed output shaft extending below the reducer coupled to the vertical shaft 98′. The supporting structure 90′, secured to the carriage body frame 86′, includes a drive support platform 93′ for the motor and reducer with a pair of vertical legs 92′ depending from the drive platform. Bearings 99′ are secured to vertical legs 92′ depending from the drive platform and are verticallly spaced to rotatably support vertical shaft 98′. Traction wheel 100′ having relatively large low pressure pneumatic rubber tire, such as commonly used on earth moving machines or all-terrain vehicles, is mounted on the lower end of vertical shaft 98′. Wheel 100′ is rotatably driven by motor 94′ and reducer 96′ in either direction as desired.

Each carriage 48′ is moved linearly by the power means 54′ which comprises a hydraulic power cylinder 82′ centrally pivoted and supported on bridge 118′ and has a conventional hydraulic power unit (not shown) supplying fluid under pressure to power cylinder 82′. Piston rod 84′ of cylinder 82′ is connected to the carriage body frame 86′ to move the carriage. As indicated on FIG. 12 the two power cylinders 82′ are spaced longitudinally from the transverse centerline of bridge 118′ to provide necessary mounting clearance.

In operation, the bridge 118′ is raised and the barge to be handled is delivered by a tug to one end of the several combination positioner and propelling mechanism assemblies 170. Each bridge 118′ is then lowered so that the traction wheels 100′ of the propelling mechanism units are adjacent the upper vertical sides of the barge. Each power cylinder 82′ is then operated to move its carriage 48′ carrying a pair of propelling mechanism units 50′ laterally of the channel until wheels 100′ come into contact with the sides of the barge. When the opposite carriage 48′ is similarly positioned so its wheels 100′ also come into contact with the sides of the barge, the barge is then held laterally under the control of the combination positioning and propelling mechanism assemblies 170. Then with the traction wheels 100′ in frictional contact with both sides of the barge and with holding pressure maintained on cylinders 82′, motors 94′ may be energized in their proper direction, depending upon their location on the sides of the barge. Traction to move the barge in the intended direction of travel will be provided by this frictional contact and the proper rotation of traction wheels 100′.

Figures 13, 14, 15:
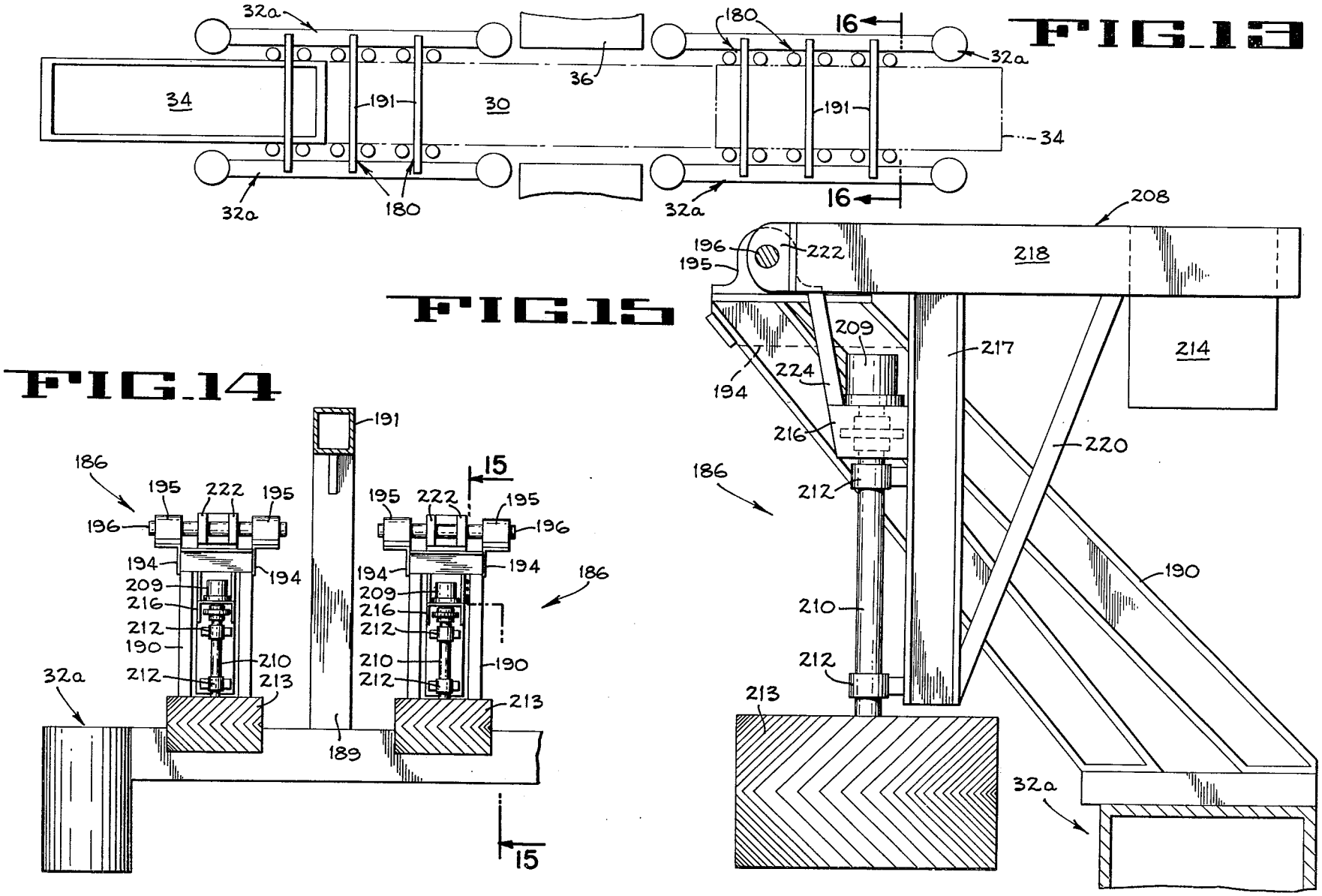
FIG. 13 is a schematic plan view of the apparatus of a barge handling system utilizing a fourth embodiment of the invention.
FIG. 14 is a sectional view taken along line 14—14 of FIG. 13.
FIG. 15 is an enlarged view of the propelling mechanism taken along line 15—15 of FIG. 14.
Figure 16:
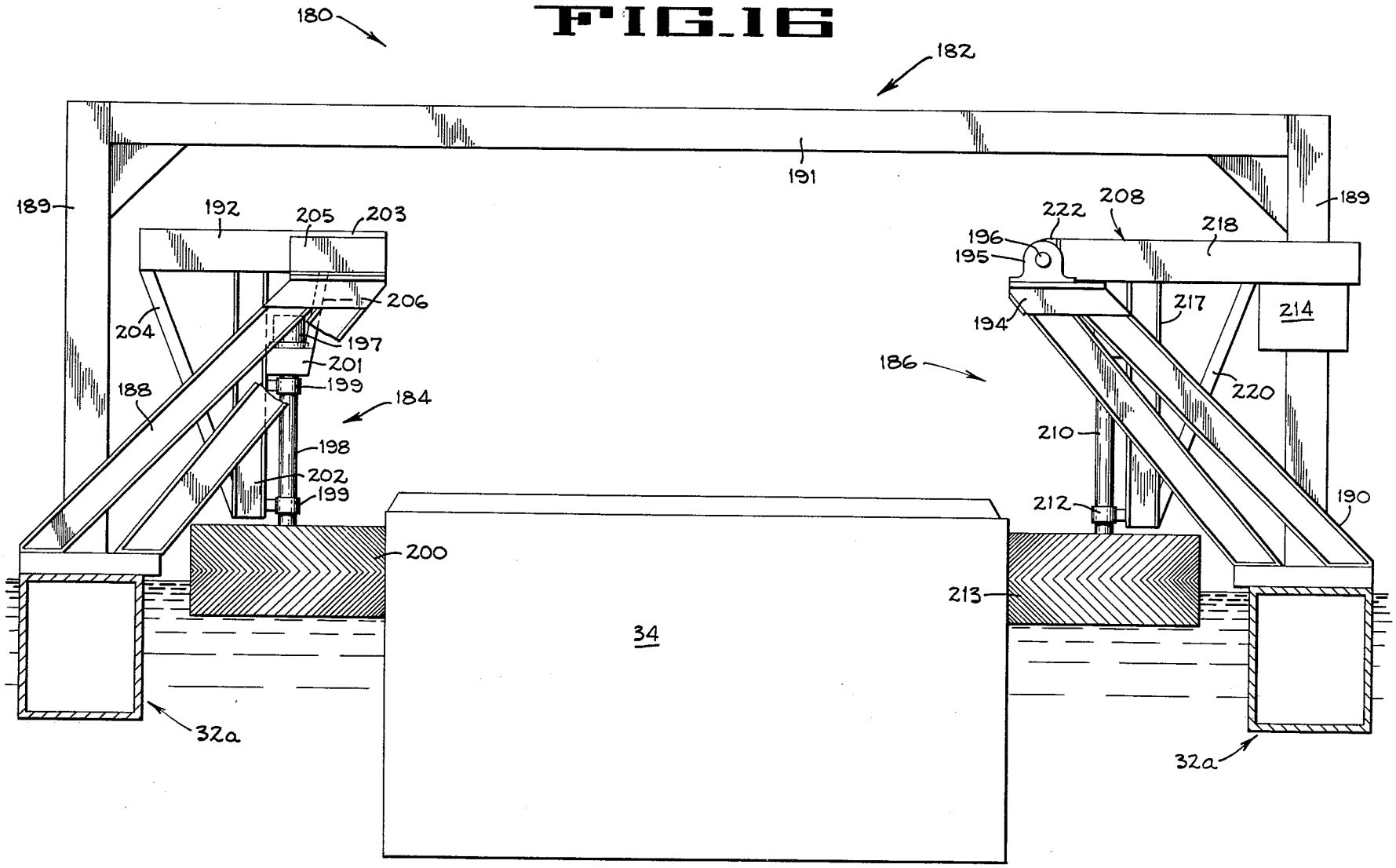
FIG. 16 is a sectional view taken along line 16—16 of FIG. 13.

A fourth embodiment of the combination positioning and propelling mechanism assembly 180 of the invention is shown on FIGS. 13–16. FIG. 13 shows a plan view of a plurality of the combination positioning and propelling assemblies 180 arranged to move a barge past a loading or unloading station. As shown in FIG. 16 the propelling mechanism units on one side of the barge are fixed laterally whereas on the opposite side the propelling mechanism units are pivotable about a horizontal axis and operate under the action of a gravity counterweight to maintain pressure of the traction wheel against the vertical side of the barge. Both fixed and pivotable propelling mechanism units are supported directly from fixed frames on piers or flotation chambers so cannot accommodate as much vertical movement of the barges or variation in water level as in other embodiments with a liftable bridge but are correspondingly simpler and more economical to manufacture where provision for such vertical motion is not required. As shown in FIG. 14 two propelling mechanism units are usually provided on each side of the barge for a single combination positioning and propelling mechanism assembly but additional units may be provided.

The combination positioning and propelling mechanism assembly 180, as shown in FIGS. 14–16, comprises a stationary structure 182, a pair of fixed propelling mechanism units 184, a pair of pivotable propelling mechanism units 186, a pair of support frames 188 for the fixed propelling mechanisms 184 and a pair of support frames 190 for the pivotable propelling mechanism units 186.

The stationary structure 182 is an inverted U-shaped structural frame having two vertical columns 189 and a horizontal beam or tube 191 rigidly connecting columns 189. The columns 189 are secured to piers or flotation chambers 32*a* and have a height sufficient for the horizontal beam 191 to clear an empty barge at maximum water level. The structure 182 acts as a tie between flotation chambers, when used, on opposite sides of the barge so that the position of the flotation chambers as a base for the frames of the propelling mechanism units will not vary.

Support frames 188 and 190 are similar in that they both have an upwardly angled structural steel frame which is anchored at its base to the flotation chamber. These frames, 188 and 190, provide a cantilevered support for the propelling mechanism units, 184 and 186 respectively, which project over the channel beyond the edge of the flotation chamber. On support frames 188 a drive support platform 192, for the fixed propelling mechanism unit 184 is rigidly attached to the upper end of the projecting portion of the frame. On support frames 190 a pair of bearing support brackets 194 is rigidly attached to the outer sides of the upper end of the projecting portion of the frame. These brackets 194 support a pair of bearings 195 which pivotally support the propelling mechanism unit 186 on a horizontal pivot shaft 196 whose axis is parallel to the longitudinal sides of the barge.

Each of the fixed propelling mechanism units 184 comprises the drive support platform 192, a fluid motor 197 with a vertically depending output shaft, a vertical shaft 198, a pair of bearings 199 and a traction wheel 200. The drive support platform 192 includes an inverted U-shaped bent plate drive support member 201, a vertical leg beam 202, a horizontal leg beam 203 and a diagonal brace 204. The vertical leg beam 202 is rigidly connected at its upper end to the horizontal leg beam 203 to form a rigid T-shaped frame. The diagonal brace 204 connects the lower end of the vertical leg beam 202 and an outwardly projecting portion of the horizontal leg beam away from the channel. The inwardly projecting portion of horizontal leg beam 203 over the channel is rigidly secured to the upper end of support frame 188 by a pair of angle brackets 205. The drive support member 201 is attached to a flange of vertical leg beam 202, opposite from the side where diagonal brace 204 is attached, at a location about one quarter of the length of vertical leg beam 202 down from horizontal leg beam 203. A brace member 206 connects the outer end of the drive support member 201 to the underside of the inwardly projecting portion of horizontal leg beam 203 to form a stiff support for the propelling mechanism machinery. Fluid motor 197 is mounted on the top of the drive support member 201 with its output shaft extending vertically downward below this member. Vertical shaft 198 is coupled to the output shaft of fluid motor 197. Bearings 199 are vertically spaced and are secured to vertical beam 202 to rotatably support the vertical shaft 198. Traction wheel 200, having a relatively large low pressure pneumatic rubber tire, such as commonly used on earth moving machines and all-terrain vehicles, is mounted on the lower end of vertical shaft 198. Wheel 200 is rotatable driven by fluid motor 197 in either direction as desired by the application of fluid pressure from a conventional hydraulic power system (not shown). It is to be noted that a conventional reversible electric motor and gear reducer drive may be substituted for the fluid motor type drive.

The pivotable propelling mechanism units 186 comprise a drive support platform 208, a fluid motor 209 with a vertically depending output shaft, a vertical shaft 210, a pair of bearings 212, a traction wheel 213 and a counterweight 214. The drive support platform 208 includes an inverted U-shaped bent plate drive support member 216, a vertical leg beam 217, a horizontal leg beam 218, and a diagonal brace 220. The vertical leg beam 217 is rigidly connected to the horizontal leg beam 218 at the upper end of the vertical beam to form a rigid T-shaped frame. The diagonal brace 220 connects the lower end of a vertical leg beam 217 and an outwardly projecting portion of the horizontal leg beam. The outwardly projecting portion of horizontal beam 218 is further extended away from the channel to support the counterweight 214. At the end of the inwardly projecting portion of horizontal beam 218, over the channel, a pair of lugs 222 are provided to receive horizontal pivot shaft 196 so as to form a pivot axis for drive platform 208 on support frame 190. The drive support member 216 is attached to a flange of vertical leg beam 217, opposite from the side where diagonal brace 220 is attached, at a location about one quarter of the length of vertical leg beam 217 down from horizontal leg beam 218. A brace member 224 connects the outer end of drive support member 216 to the underside of the inwardly projecting portion of horizontal leg beam 218 to form a stiff support for the propelling mechanism machinery. Fluid motor 209 is mounted on the top of drive support member 216 with its output shaft extending vertically downward below this member. Vertical shaft 210 is coupled to the output shaft of fluid motor 209. Bearings 212 are vertically spaced and are secured to vertical leg beam 217 to rotatably support the vertical shaft 210. Traction wheel 213, having a relatively large low pressure pneumatic rubber tire, such as commonly used in earth moving machines or all-terrain vehicles, is mounted on the lower end of vertical shaft 210. Traction wheel 213 is rotatably driven by fluid motor 209 in either direction as desired by the application of fluid pressure from a conventional hydraulic power system (not shown).

Since traction wheel 213 and its driving machinery are supported on drive platform 208 which is pivotally mounted to support frame 190, the wheel is urged into contact with the side of the barge by the gravity action of counterweight 214 and this contact is automatically maintained by the action of the counterweight. This pivotable propelling mechanism unit 186 further provides for minor variations in the width of the barges.

Figure 17:
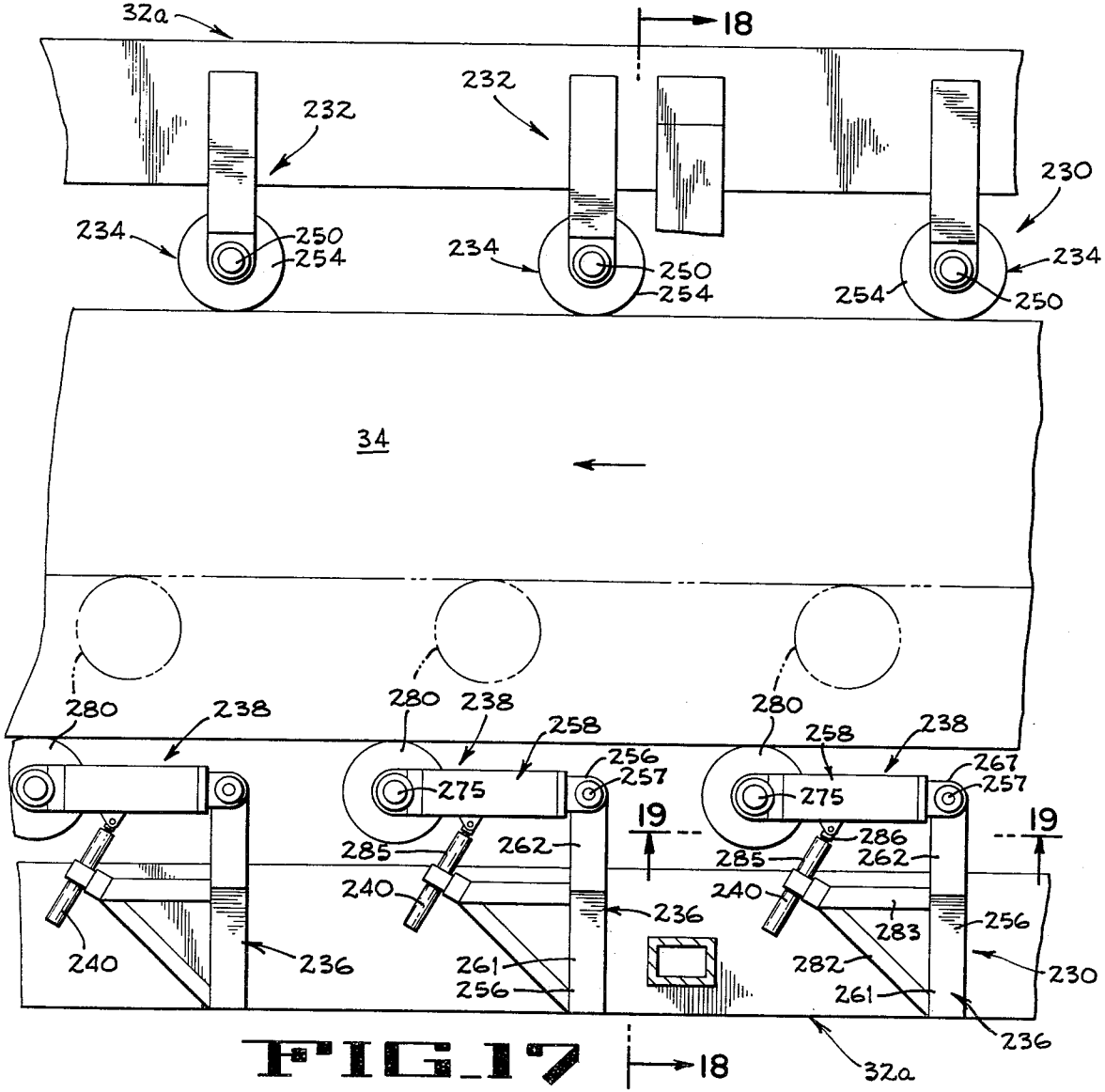
FIG. 17 is a plan view of a barge handling system utilizing a fifth embodiment of the invention.

A fifth embodiment of the combination positioning and propelling mechanism assembly 230 of the invention is shown in FIGS. 17–20. As shown in FIG. 17 the propelling mechanism units on one side of the barge are fixed laterally whereas on the opposite side of the barge, the propelling mechanism units are pivotable about a vertical axis to swing in a horizontal arc against the vertical side of varying width barges. Both fixed and pivotable propelling mechanism units are supported directly from fixed frames supported on the piers or flotation chambers so cannot accommodate as much vertical movement of the barges or variations in water level as in other embodiments with a liftable bridge, but are correspondingly simpler and more economical to manufacture where provision for such vertical motion is not required.

The combination positioning and propelling mechanism assembly 230 comprises a fixed support frame 232, a fixed propelling mechanism unit 234, a pivotable support frame 236, a laterally adjustable propelling mechanism unit 238 and power means 240 to laterally adjust propelling mechanism unit 238. A plurality of assemblies 230 may be spaced longitudinally along the channel according to the length of the barges to be used and their travel past the loading or unloading station.

The fixed support frame 232 which is anchored at its base to the flotation chambers or piers includes upwardly angled beams 242 and 243 suitably braced by members 244 and 245, a machinery platform 246 and a vertical leg beam 247. The machinery platform 246 is an inverted U-shaped bent plate member attached to the top of vertical beam 247. Both the machinery platform 246 and the vertical beam 247 are further secured to angled beams 242 and 243 to form a single rigid frame.

The fixed propelling mechanism unit 234 comprises a fluid motor 250 with a vertically depending output shaft, a vertical shaft 251, a pair of bearings 252, and a traction wheel 254. The fluid motor 260 is mounted on the top of the machinery platform 246 with its output shaft extending vertically downward below the platform. Vertical shaft 251 is coupled to the output shaft of the fluid motor 250. Bearings 252 are vertically spaced and are secured to vertical beam 247 to rotatably support vertical shaft 251. Traction wheel 254, having a relatively large low pressure pneumatic rubber tire, such as commonly used on earth moving machines and all-terrain vehicles, is mounted on the lower end of vertical shaft 251. Traction wheel 254 is rotatably driven by fluid motor 250 in either direction as desired by the application of fluid pressure from a conventional hydraulic power system (not shown).

The pivotable support frame 236 comprises a fixed frame section 256, a vertical pivot shaft 257 and a hinged frame section 258. The fixed frame section 256, which is anchored at its base to the flotation chambers or piers includes a horizontal beam 260, an upwardly inclined beam 261 with a horizontally extending portion 262 at its upper end, and bracing members 263 and 264. The outer ends of beam 260 and horizontally extending portion 262 of beam 261 provide means for supporting vertical pivot shaft 257. Hinged frame section 258 includes a pair of horizontal beams 266 with horizontally extending end portions 267 which provide means to receive vertical pivot shaft 257. The opposite ends of horizontal beams 266 are joined to a vertical beam 268. Interior bracing members 269, 270 and 271 are rigidly connected to horizontal beams 266 to provide a single rigid framework. A machinery platform 272, in the form of an inverted U-shaped bent plate member, is rigidly attached to the upper portion of vertical beam 268.

The laterally adjustable propelling mechanism unit 238 comprises a fluid motor 275 with a vertically depending output shaft, a vertical shaft 276, a pair of bearings 278, and a traction wheel 280. The fluid motor 275 is mounted on the top of the machinery platform 272 with the output shaft of the fluid motor extending vertically downward below the platform. Vertical shaft 276 is coupled to the output shaft of the fluid motor 275. Bearings 278 are vertically spaced and are secured to vertical beam 268 of the hinged frame 258 to rotatably support vertical shaft 276. Traction wheel 280, having a relatively large low pressure pneumatic rubber tire, such as commonly used on earth moving machines and all-terrain vehicles, is mounted on the lower end of vertical shaft 276. Traction wheel 280 is driven by fluid motor 275 in either direction as desired by the application of fluid pressure from a conventional hydraulic power system (not shown). It is to be noted that a conventional reversible electric motor and gear reducer drive may be substituted for the fluid motor type of drive.

Beams 282 and 283 are attached to the horizontal beam 260 of fixed frame 256 and extend horizontally to one side to form, where joined at their outer ends, a fixed support for the power means 240 which laterally adjusts propelling mechanism unit 238. Power means 240 comprises a hydraulic power cylinder 285 pivotally mounted to the joined ends of beams 282 and 283 with its piston rod 286 pivotally connected to the lower one of the pair of horizontal beams 266 of the hinged frame 258. By application of fluid pressure from a conventional hydraulic power system (not shown) piston rod 286 of power cylinder 285 may be extended and the hinged frame 258, carrying the laterally adjustable propelling mechanism unit 238 may be moved from a storage position with the hinged frame 258 parallel to the flotation chamber to an extended position with the hinged frame 258 perpendicular to the flotation chamber. In practice the hinged frame 258 and the propelling machanism unit 238 are extended only until wheel 280 of the propelling mechanism unit 238 is brought into contact with the vertical side of the barge, but varying width barges may be accommodated by varying the extension of piston rod 286. Once contact with the barge is made by wheel 280 fluid pressure is maintained on power cylinder 285 to hold wheel 280 in this position so it may properly position and control the barge laterally.

Figure 20:
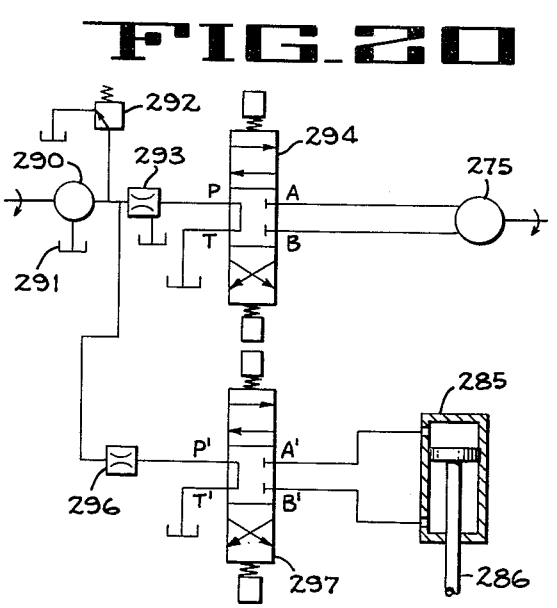
FIG. 20 is a schematic hydraulic circuit diagram for the embodiment shown in FIGS. 17–19.
Figure 19:
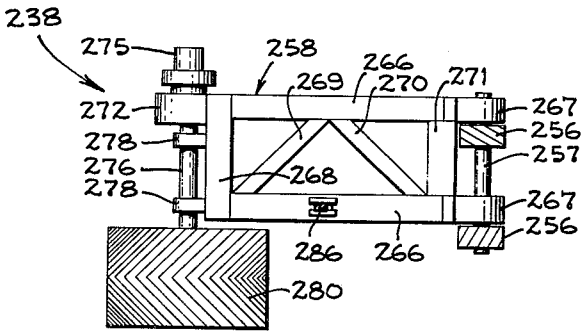
FIG. 19 is a sectional view taken along line 19—19 of FIG. 17.
Figure 18:
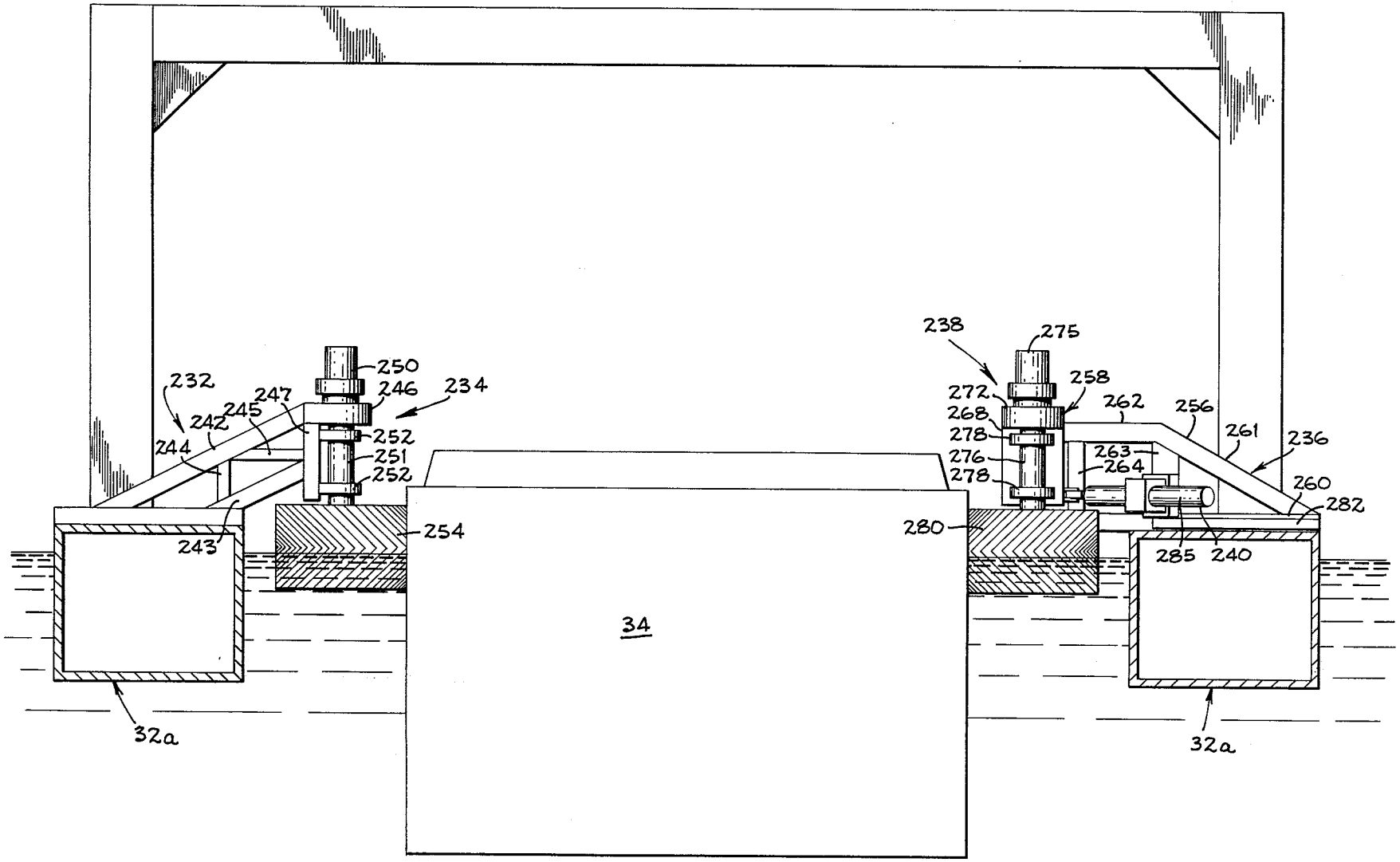
FIG. 18 is a sectional view taken along line 18—18 of FIG. 17.

FIG. 20 shows a schematic hydraulic circuit for a hydraulic power system for operating the fifth embodiment shown by FIGS. 17–19. This includes a hydraulic pump 290, a fluid tank 291 and system pressure relief valve 292. Fluid under pressure is supplied in one branch of the circuit through a pressure compensated variable speed control valve 293 to a double solenoid operated three position four port control valve 294 having the pump port P open to the tank port T and the ports A and B to the fluid motor 275 blocked in the valve's central position. Fluid under pressure is supplied to another branch of the circuit through a pressure compensated variable speed control valve 296 to a double solenoid operated three position four port control valve 297 having the pump port P′ open to the tank port T′ and the ports A′ and B′ to the cylinder 285 blocked in the valve's central position. Selective actuation of solenoid valve 295 in one direction or the other will drive motor 275, and hence wheel 280, in one direction or the other. Selective actuation of solenoid valve 297 in one direction or the other will swing hinged frame 258 in one direction or the other.

Although the best modes contemplated for carrying out the present invention have been herein disclosed and described, it will be apparent that modification and variation may be made without departing from what is regarded to be the subject matter of the invention.

What is claimed is:

1. A combination positioning and propelling mechanism assembly for moving barges through a bulk material loading or unloading facility, the combination comprising:

a. a fixed supporting structure secured to piers on each side of a channel through which the barges pass, the structure having a pair of towers on each side of the channel extending vertically above the barge in the highest position of the barge, a pair of longitudinal beams connecting the top of the pair of towers on each longitudinal side of the channel and a pair of transverse beams spanning the channel and connecting the tops of oppositely positioned towers, the towers, the longitudinal beams and the transverse beams forming a single rigid rectangular supporting structure;

b. a liftable bridge spanning the channel and having a rectangular structural frame supported to move vertically within said fixed supporting structure and to be guided by fixed guide rails attached to the piers from a raised non-operating position above the barge to a lowered operating position;

c. a wire rope hoisting system including a drum shaft assembly having three drums on a common shaft rotatably supported on one longitudinal beam, a pair of spaced wire rope sheaves rotatably supported on the other longitudinal beam, a power driven drum type hoist unit mounted on one pier adjacent one of the towers, four wire rope cables, one end of each cable being secured to a corner of said liftable bridge, two of the cables passing vertically upward and over the sheaves then passing transversely to a first and second drum on the three drum shaft assembly, the other two cables passing vertically upward directly to the first and second drums, a fifth wire rope cable connected to a third drum of the three drum shaft assembly passes to the hoist unit, whereby operation of the hoist unit raises and lowers said bridge;

d. a wheeled carriage operating on a pair of horizontal longitudinally spaced rails mounted on one lateral end of said liftable bridge, said carriage movable transversely of the channel;

e. reciprocable power means mounted on said bridge and connected to said carriage providing linear motion to move said wheeled carriage on the horizontal rails of said bridge transversely of the channel;

f. at least one adjustable propelling mechanism unit mounted on said movable carriage, said propelling mechanism unit comprising an elongated vertical shaft rotatably supported from said carriage and extending below said bridge, a traction wheel mounted on the lower end of the vertical shaft and a first power means attached to said carriage and connected to the vertical shaft to reversibly rotate the shaft and the traction wheel, said propelling mechanism unit being adjustable transversely of the channel for positioning the traction wheel against the vertical side of the barge by moving said carriage; and g. at least one non-adjustable propelling mechanism unit mounted on the other lateral end of said bridge from said adjustable propelling mechanism, said non-adjustable propelling mechanism comprising an elongated vertical shaft rotatably supported from and extending below said bridge, a traction wheel mounted on the lower end of the vertical shaft, and a second power means to reversibly rotate the shaft and the traction wheel, whereby when said bridge is lowered to bring the traction wheels in position vertically adjacent the upper portion of the barge, and said carriage is moved laterally to bring the traction wheel on said adjustable propelling mechanism unit into contact with the side of the barge, the barge is positioned between said fixed and adjustable propelling mechanism units and rotation of the traction wheels in their proper direction will propel the barge longitudinally in the channel.

2. The combination positioning and propelling mechanism assembly of claim 1 wherein each of the traction wheels of the propelling mechanism units comprises a wheel with a low pressure pneumatic rubber tire having a high friction tread.

3. A combination positioning and propelling mechanism assembly for moving barges longitudinally in a channel, the combination comprising:

a. a fixed structure anchored on each side of the channel and transversely spanning the channel;

b. at least a pair of propelling mechanism units, one of said units being located on one side of a barge having a pair of transversely spaced longitudinal sides and the other unit being located on the opposite side of the barge from the one unit, each of said propelling mechanism units having a substantially horizontal tractional device mounted on the lower end of a substantially vertical shaft with a reversible drive connected to the shaft to rotate the shaft and the tractional device;

c. a transverse bridge with a powered hoisting system operably connected between the bridge and said fixed structure, said bridge carrying said propelling mechanism units, said bridge vertically movable within said fixed structure from a non-operating position with said tractional devices above and clear of the barge to an operating position with the tractional devices adjacent the longitudinal sides of the barge; and d. means to move at least one of said propelling mechanism units toward and away from the other unit to bring the tractional devices into frictional contact with the longitudinal sides of the barges for moving the barge longitudinally by means of the tangential frictional contact when the tractional devices are rotated, said means to move at least one of said propelling mechanism units comprises a wheeled carriage mounted on said transverse bridge to move transversely of the channel, said wheeled carriage supporting one of said propelling mechanism units, and reciprocable power means connected between said bridge and said movable carriage to move said carriage and the one propelling mechanism unit so the tractional device of the one propelling mechanism unit contacts one longitudinal side of the barge, positions the barge laterally with the opposite side of the barge in contact with the tractional device of the other propelling mechanism unit, and maintains pressure on the transversely adjustable tractional device preventing lateral movement of the barge while the barge is moved longitudinally.

* * * * *